United States Patent [19]

Reichenberger

[11] 4,162,028

[45] Jul. 24, 1979

[54] BEVERAGE DISPENSING SYSTEM

[76] Inventor: Arthur M. Reichenberger, 1916 N. 21st Pl., Phoenix, Ariz. 85006

[21] Appl. No.: 767,772

[22] Filed: Feb. 11, 1977

[51] Int. Cl.[2] ..... B67D 5/06

[52] U.S. Cl. ..... 222/129.4; 222/144.5; 200/5 R

[58] Field of Search ..... 222/14–22, 222/129.1–129.4, 144.5; 200/5 R, 157

[56] References Cited

U.S. PATENT DOCUMENTS

| | | | |
|---|---|---|---|
| 3,409,175 | 11/1968 | Byrne | 222/129.4 X |
| 3,785,526 | 1/1974 | Shinn | 222/14 |
| 3,830,405 | 8/1974 | Jaeger | 222/129.3 |
| 3,920,149 | 11/1975 | Fortino et al. | 222/129.3 X |
| 3,947,390 | 3/1976 | Johnson | 200/5 R |
| 3,991,911 | 11/1976 | Shannon et al. | 222/144.5 X |

*Primary Examiner*—Joseph J. Rolla

[57] ABSTRACT

The disclosure relates to a beverage dispensing system for liquor, soft drinks, or mixed drinks comprising: a display board indicating the location of multiple groupings of ingredients which correspond to a similar locational layout of selector buttons on the dispenser handset. The disclosure also relates to a dispenser handset which can be switched to various modes so that a small number of selector buttons can select any one ingredient from multiple groupings of ingredients on the display board. The dispenser handset is connected by multiple flexible control and supply lines to an electronic dispensing control, and multiple displacement pumps and ingredient supplies. The disclosure also relates to an electronic dispensing control with display board lighting and recording counters and is disposed to delay the first selected ingredient of a pre-determined quantity until the selection of the second ingredient is made. The second ingredient therefore is dispensed simultaneously with the first ingredient and the dispensed quantity of the second ingredient is controlled by the operator. The dispensing control can alter the preset quantity of the first ingredient upon receiving proper signals from the control switches.

11 Claims, 7 Drawing Figures

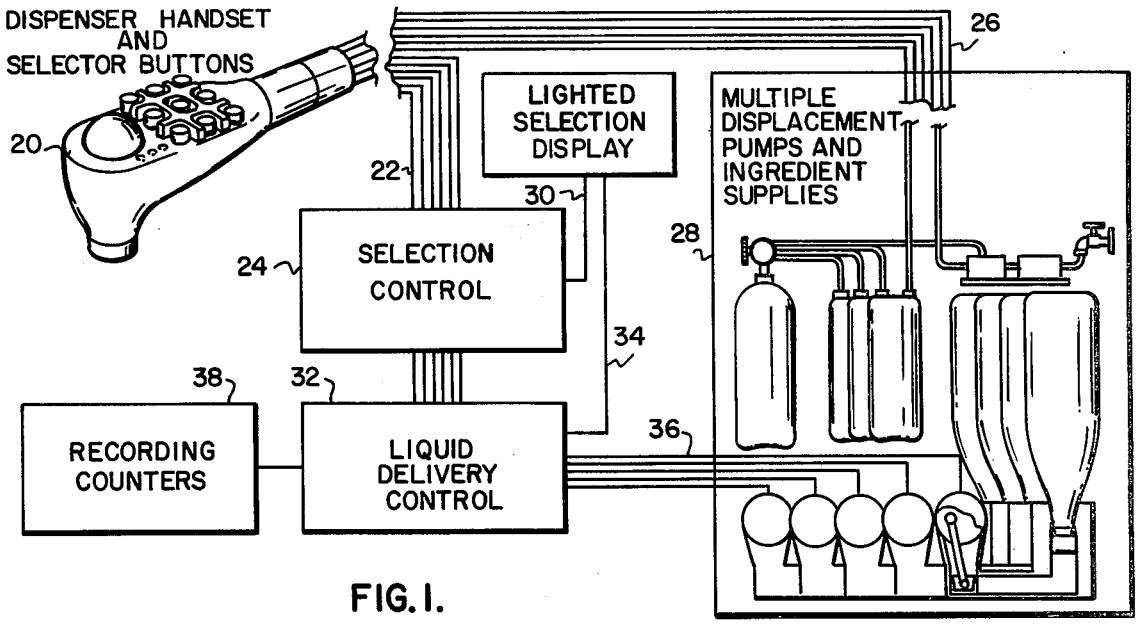
FIG. 1.
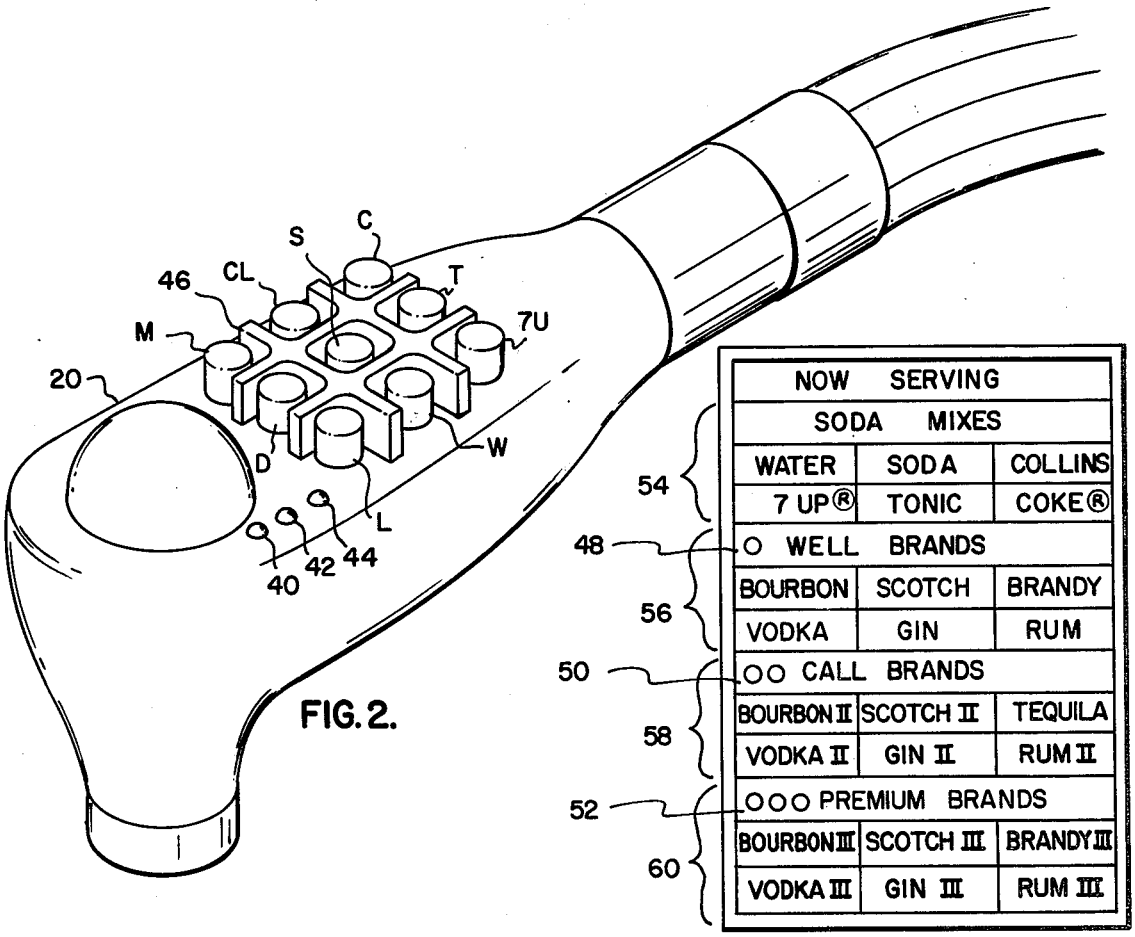
| NOW SERVING | | |
|---|---|---|
| SODA MIXES | | |
| WATER | SODA | COLLINS |
| 7 UP® | TONIC | COKE® |
| O WELL BRANDS | | |
| BOURBON | SCOTCH | BRANDY |
| VODKA | GIN | RUM |
| OO CALL BRANDS | | |
| BOURBON II | SCOTCH II | TEQUILA |
| VODKA II | GIN II | RUM II |
| OOO PREMIUM BRANDS | | |
| BOURBON III | SCOTCH III | BRANDY III |
| VODKA III | GIN III | RUM III |
FIG. 2.
FIG. 3.

BEVERAGE DISPENSING SYSTEM

BACKGROUND OF THE INVENTION

Prior art of mechanically dispensing cocktail ingredients includes the well known soda mix dispensing handset with multiple flexible supply lines and electrically controlled valves. Variations of this system are now used in over ninety percent of the bars in this country. Their success was primarily due to the time saved in mixing cocktails. Early liquor dispensers measured and recorded, but did not dispense directly into the glass at the mixing station. This caused slowdown of the mixing process and such systems failed to attain substantial acceptance.

There have been attempts to computerize the simultaneous dispensation of predetermined quantities of liquor and various mixes or soda, but the selection of proper buttons or punched cards and the necessity of moving individual glasses to the dispensing spout still caused a slowdown in the total drink making time.

These systems were failures, saleswise, because they lengthened the drink making time.

The most successful liquor dispensers, saleswise, are those which have flexible supply lines and a handset similar to those used with soda mixes, and intended to be used with one hand while the soda mix dispenser is used with the other. The theory was good, but in practice most bartenders still dispense liquor first and then fill the glass with a soda mix, wasting valuable time. Some bartenders try to use both liquor and soda dispensers at the same time, but in most cases, valuable liquor is spilled from its handset while he is reaching for or looking for the proper button to push on the soda handset. In either case, it is a two handed operation and the bartender has to wait until the glass is filled before he can add other condiments such as cherries, limes, or the like.

A recent attempt to combine the liquor and soda in one flexible hose, U.S. Pat. No. 3,830,405, has the same time loss and/or spillage problem, since only one ingredient can be dispensed at a time. If the soda mix is selected before the liquor dispensing is completed, there is an even worse danger of spilling liquor while searching for the proper soda mix button. The combined dispenser, referred to above, either limits the numer of ingredient selections or makes the selection buttons so numerous that it is time consuming to find the proper button.

SUMMARY OF THE INVENTION

The present invention comprises a novel combination of: a display board listing a group of soda mixes, a group of well liquors, a group of call liquors and a group of premium liquors, each having a locational layout corresponding to the layout of one set of selector buttons equal in number to one group of the aforementioned mixes or classes of liquors; a moveable dispenser handset with flexible ingredient supply lines and a set of selector switches coupled with an electronic dispenser control; an electronic selection control, which may be disposed by actuation of one of the dispenser handset switches to a mode which will cause the dispensing of one brand of liquor selected from one of the various groups, namely, well, call and premium.

Said dispenser selection control is disposed to delay or put into memory the liquor selection and activate that section of said selection control which will receive a command from a dispenser handset switch to dispense one of the soda mixes. When a soda mix switch is actuated, the dispenser selection control will cause the simultaneous dispensing of a predetermined quantity of liquor and an operator controlled quantity of soda mix.

A dispenser control is disposed to receive the command from the selection control and drive proper ingredient supply pumps and/or solenoid valves, and light the display board and record the item dispensed. Said dispenser control is disposed to have electronically adjustable preset quantities, and be capable of delivering various preset quantities, such as one and one half portions for a martini or a double portion, upon command by the dispenser handset control switches via the selection control.

A positive displacement pump constitutes a liquid delivery means for each ingredient with a flow sensing or signal generator disposed to give a series of electronic signals, each relative to an exact volume of liquid displaced. The electronic control counts these signals and stops the pump when an electronically alterable preset number of counts is reached.

The water, soda and syrup may be dispensed by the conventional pressure methods or by the same precise pumps and control used for liquor.

In multiple installations, the functions of selection control and dispenser control might be performed by a general purpose programmable digital microprocessor. Less sophisticated installations might provide fewer liquor selections, without the lighted display board and employ a time delay to prevent the immediate dispensing of liquor to effect a simultaneous dispensing of the liquor and soda.

Accordingly, it is an object of the present invention to speed the making of cocktails by providing a means of dispensing both liquor and soda simultaneously through a moveable dispenser handset with flexible delivery tubes.

Another object of the invention is to speed the making of mixed drinks by providing a single moveable dispenser operable with one hand, freeing the other hand to ice glasses or add condiments, such as cherries, limes, or the like.

Another object of the invention is to prevent confusion and mixtakes by providing a dispenser handset with a limited number of selection buttons and providing multiple use of the same buttons by switching the mode to other classes of liquor or soda mixers.

Another object of the invention is to prevent spillage by providing a means of delaying the liquor dispensation, after selection, until after the mode automatically switches the selector buttons back to soda mixes group and the soda is selected giving simultaneous dispensing of both liquor and soda.

Another object of the invention is to provide a novel tick-tack-toe guard to facilitate the nonvisual locational referencing of the operator's thumb while making selections and prevent the inadvertant bumping or depressing of more than one button.

Another object of the invention is to provide a separate display lighted according to the mode group selected with the handset so that the operator can determine visually the desired selection location on the large display board and depress nonvisually the corresponding button in a similar location on the dispenser handset.

Another object of the invention is to provide an electronic means of changing the preset quantity of liquor to be dispensed for cocktail hours, martinis, or the like.

Further objects and advantages of the invention may be apparent from the following specification, appended claims and accompanying drawings.

BRIEF DESCRIPTION OF THE DRAWINGS

FIG. 1 is a block diagram of the dispenser system of the invention;

FIG. 2 is a perspective view of the dispenser handset of the invention;

FIG. 3 is a front elevation view of the display board of the invention lighted to indicate selection mode groups and the particular brand being served.

DESCRIPTION OF THE PREFERRED EMBODIMENTS

Figure 4:
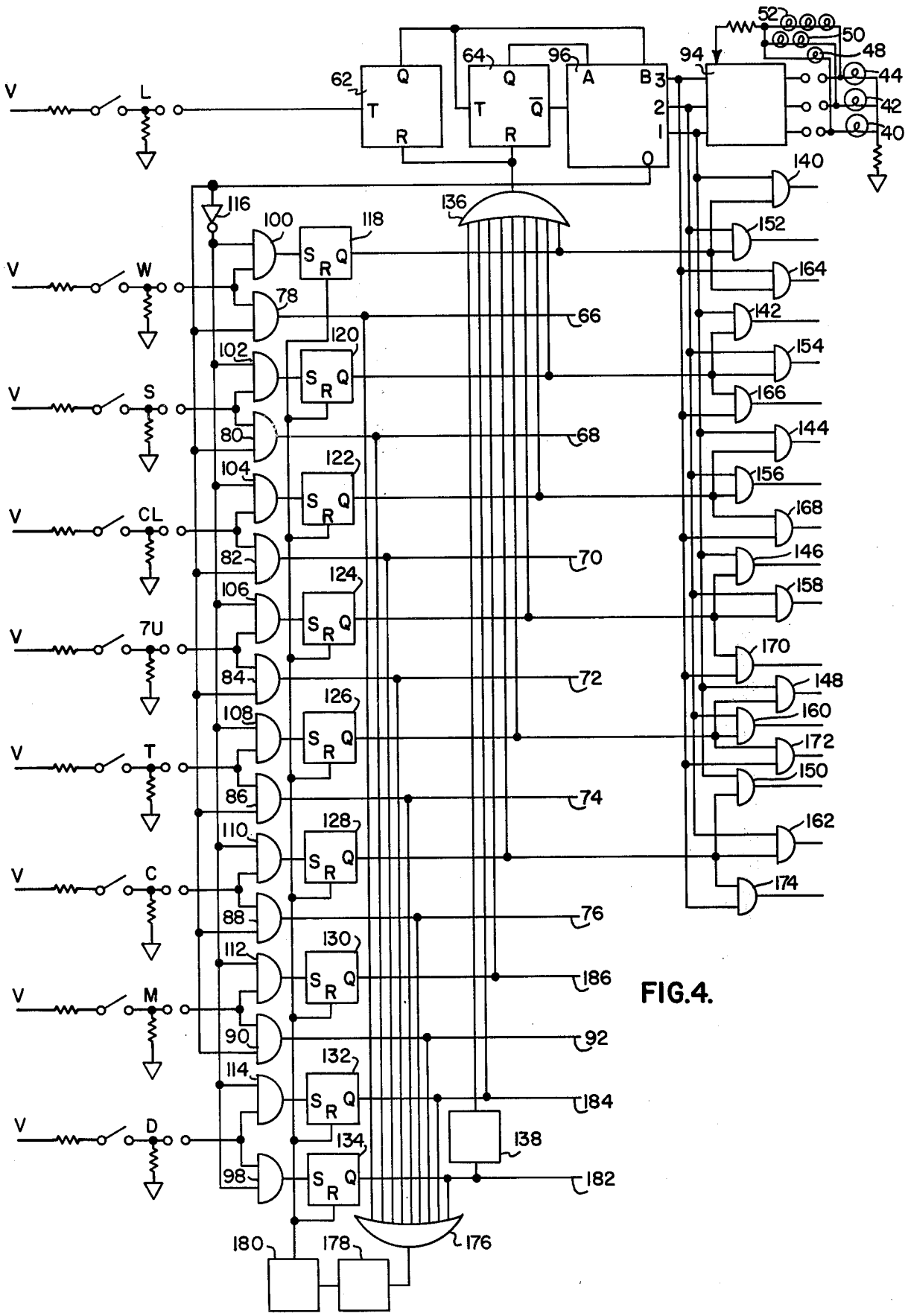
FIG. 4 is a diagramatic view of electrical circuitry pertaining fo control and selector switches on the handset mode control, indicator lights, and selection control.

Reference is hereby made to FIG. 1, which generally illustrates the complete beverage dispensing system of the present invention in block diagram.

Among the principal elements are the dispenser handset 20, connecting electrical control lines 22, selection control section of the electronics 24, flexible supply lines 26, multiple displacement pumps and ingredient supplies 28, electrical lines 30 to illuminate proper mode lights, liquid delivery control 32 which can be part of the same circuit board including selection control 24, both 24 and 32 being referred to in the claims as electronic control means. Said principal elements also include electrical lines 34 to illuminate the particular brand panel while it is being dispensed, electrical lines 36 to drive the particular pump for the brand being dispensed, recording counters 38 to record the class of liquor being dispensed, namely, well, call or premium brands.

Reference is hereby made to FIG. 2 which is a perspective view of the dispenser handset 20, which is designed to be held in one hand by the bartender, and includes a set of nine push buttons designated by letters L, D, M. W, S, Cl, 7u, T and C.

The repeated actuation of control button L changes the mode selector in selection control 24, FIG. 1, from its normal state, soda mix mode group, to well brands mode group, to call brands mode group, to premium brands mode group, then back to its normal state. Actuation of button D before any liquor selection will result in a double shot being dispensed. Actuation of button D after any liquor selection will result in the dispensing of liquor only.

Actuation of button M before any liquor selection will result in a larger quantity being dispensed. Actuation of button M after liquor has been selected will result in the dispensing of vermouth as long as it remains depressed.

Actuation of any of the remaining six buttons W, S, Cl, 7u, T and C, after the liquor mode button L has been actuated will cause the selection of a particular brand of liquor depending on which mode has been selected.

After selecting any liquor, the mode selector automatically returns to the soda mix mode group and the subsequent actuation of the buttons W, S, Cl, 7u, T or C will select and dispense the desired soda mix as long or as often as these buttons are depressed.

Lights 40, 42 and 44 indicate the mode group or liquor class available for selection after sequential actuation of mode control button L. Tick-tack-toe referencing guard 46 serves to prevent inadvertant actuation of the selector buttons and assist nonvisual locational selections with the thumb.

Reference is hereby made to FIG. 3, which is a front elevational view of the lighted display board which is disposed to indicate by lights 48, 50 and 52 which mode group has been selected by control button L on the dispenser handset 20 of FIG. 2.

The display board also illuminates individual panels indicating the brand of liquor and the type of soda mix selected by the bartender on buttons W, S, Cl, 7u, T and C on the dispenser handset 20 of FIG. 2.

In FIGS. 2 and 3 of the drawings, the location of the last six buttons of the dispenser handset 20 correspond locationally to the six brand selections of each mode group on the display; soda mixes 54, well brands 56, call brands 58 and premium brands 60. For example, referring to FIGS. 2 and 3 of the drawings, if scotch II and water were desired, the bartender would depress mode group selector button L twice. Lights 40 and 42 on the handset and 50 on the display board would illuminate to indicate the call brand mode group was selected. The operator would then depress button S on the dispenser handset nonvisually, since it is in the same location on the handset as the brand scotch II is on the display board. Mode group lights 40, 42 and 50 now go off and the display panel scotch II lights up. The bartender would then push button W to select water from the soda mix mode group 54. The panel light behind the sign water goes on indicating that scotch II and water are being dispensed simultaneously.

It is obvious that the display board could cooperate by indicating the location for brand selections without being lighted and that its form could be modified and placed in any visible locations. In less sophisticated systems with only two mode groups, the soda group selections could be marked on the selector buttons and the liquor group locations indicated on the dispenser handset.

Reference is hereby made of FIG. 4 of the drawings which is a partial circuit diagram pertaining to: the dispenser handset control and switches L, D, M, W, S, Cl, 7u, T and C, also shown in FIG. 2; a circuit diagram for the selection control 24 also shown in FIG. 1; mode group indicator lights 40, 42 and 44 also shown in FIG. 2; and mode group indicator lights 48, 50 and 52 on the display board also shown in FIG. 3.

The normal state of both toggle flip-flops 62 and 64 is their zero state, the soda mix group mode 54 as shown in FIG. 3. Actuation of switches W, S, Cl, 7u, T or C causes the demand dispensing of any soda mix by signals to the outputs 66, 68, 70, 72, 74 and 76 through AND gates 78, 80, 82, 84, 86 and 88. The dispenser control 32, shown in FIG. 1 of the drawings, will drive proper solenoid valves to dispense the selected soda mix. The detail of this circuitry is not shown in this disclosure, as it is a well established means. Actuation of switch M performs the same as the soda switches W, S, Cl, 7u, T and C when in the normal zero state or soda mix group mode through AND gate 90 to output 92 to deliver vermouth.

One actuation of liquor mode switch L energizes toggle flip-flop 62 from the zero state to the One state. Toggle flip-flop 64 remains in its initial zero state. Lamp 40 and 48 are illuminated through driver circuit 94 and binary to decimal decoder 96, to indicate the mode has been switched for well brand selection. This inhibits AND gates 78, 80, 82, 84, 86, 88, 90 and 98, while enabling AND gates 100, 102, 104, 106, 108, 110, 112 and 114 through inverter 116 and binary flip-flops 118, 120, 122, 124, 126, 128, 120 and 132.

A momentary activation of any one of the switches D, W, S, Cl, 7u, T or C will change the state of one of the binary flip-flops 118, 120, 122, 124, 126, 128, 130 or 134 from the zero state to the One state indicating the selection of liquor as memory. This selection resets toggle flip-flops 62 and 64 to the zero state via OR gate 136 and delay 138 automatically changing the mode back to soda mixes. Modes for call brands, state Two, and premium liquors, state Three, of binary to decimal decoder 96 may be selected by two consecutive actuations or three consecutive actuations of switch L and operate exactly the same as described above with one actuation of switch L, except information from the binary to decimal decoder 96 enables different sets of six AND gates.

Well brand mode, state One, of the binary to decimal decoder 96 enables AND gates 140, 142, 144, 146, 148 and 150. Call brand mode, state Two, of the binary to decmial decoder 96 enables AND gates 152, 154, 156, 158, 160 and 162. Premium brand mode, state Three, of binary to decimal decoder 96 enables AND gates 164, 166, 168, 170, 172 and 174.

After the liquor selection is in the memory and the toggle flip-flops are in the normal zero state, or soda mix mode, selection of any of the switches W, S, Cl, 7u, T, C or M causes the simultaneous dispensing of the previously selected liquor and the now selected soda mix or vermouth. A signal via OR gate 176, Delay 178, and One-Shot 180 resets binary flip-flops 118, 120, 122, 124, 126, 128, 130, 132 and 134, removing from their memory any previously selected liquor.

If a double shot is desired, switch D may be actuated while binary to decimal decoder 96 is in one of the liquor mode states One, Two or Three followed by a liquor selection from switches W, S, Cl, 7u, T or C and a soda mix selection from the same switches.

If liquor only is desired, switch D may be actuated after liquor selection has been made to change binary flip-flop 134 to the One state through AND gate 98 and output 182.

Figure 5:
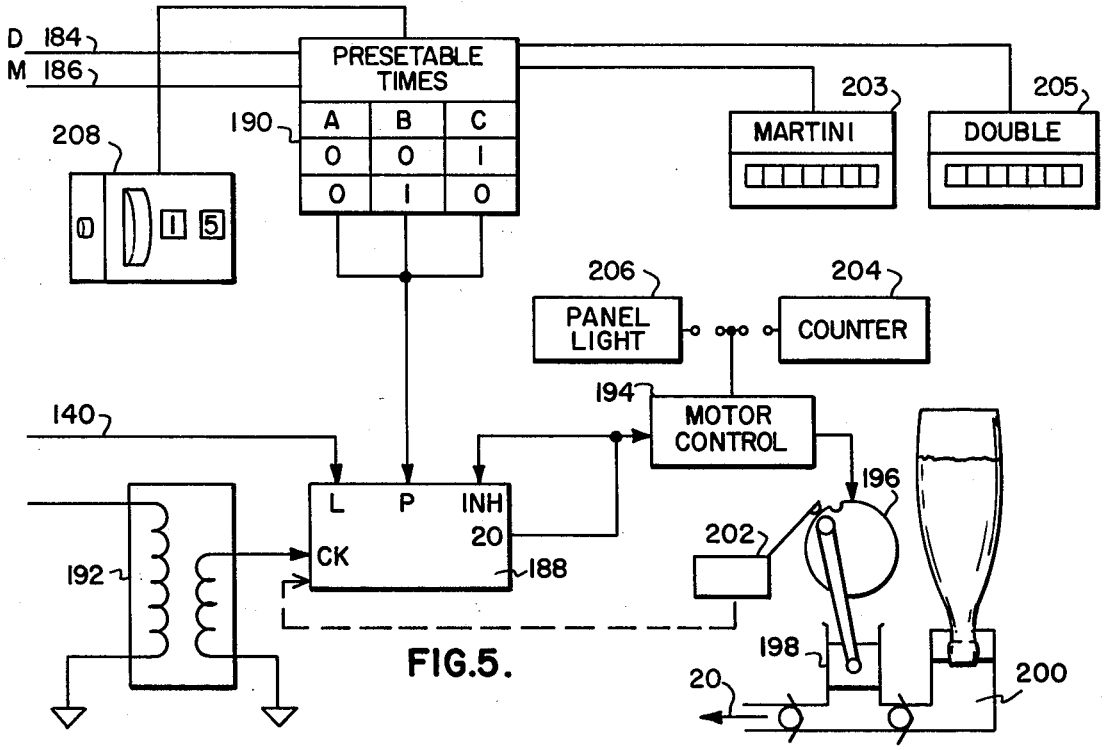
FIG. 5 is a block diagram of a typical circuit of a liquid delivery control of the invention.

The output of AND gates 140 through 174 will activate the proper section of dispenser control 32 in FIG. 1 to complete one complete dispensing cycle described in FIG. 5. The activation of switches D for a double shot or M for a long martini shot will alter the preset count of base number generator 208, shown in FIG. 5, through output leads 184, or 186.

Figure 7:
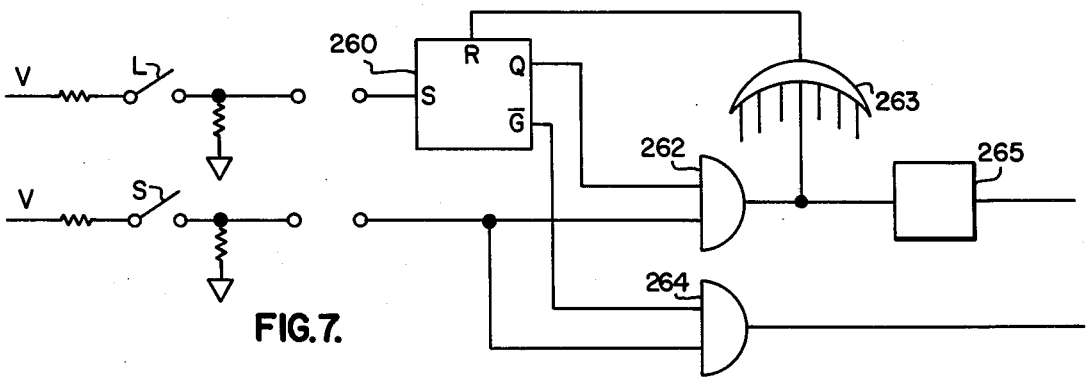
FIG. 7 is a partial circuit diagram pertaining to the handset selector switches and selection control describing an alternate method of delaying the dispensing of liquor until the bartender has had time to select the soda mix.

While the preferred means of delaying the dispensing of the liquor selection until the soda selection is made to avoid spillage is described in the diagram in FIG. 4, it should be understood that more conventional methods can be employed such as; holding relays, thermal or capacitor discharge time delays and the like, as shown in FIG. 7.

Reference is hereby made to FIG. 5 of the drawings which is a block diagram of the electrical control circuit, typical of that required for each liquor supply pump. An output signal from a specific AND gate, such as 140 in FIG. 4, coupled at junction (L) will cause the liquid delivery control 188, a presetable binary counting device such as Motorola's MC 40198 B or RCA's CD 40193 B, sometimes referred to as a down counter, to go to the value equal to the preset input A, B or C shown as a logic table 190. Clock input (CK) of down counter is connected to a 60 cycle AC lead of transformer 192. Down counter 188 zero-out (ZO) line enables motor control 194 to start synchronous motor 196 to start pump 198 displacing liquor from reservoir 200 to the dispenser handset 20. At the same time, down counter 188 starts counting down to zero at the rate of 60 counts per second from the preset input number received at (P) from A, B or C of 190. When down counter 188 reaches zero, motor control 194 changes state, stopping motor 196. Zero output stays at zero because it is connected to the synchronous break motor, therefore displacing a predetermined quantity of liquor.

An alternate cycle counting means would be to have a cycle generating with 202 connected to the (CK) terminal of the down counter as shown by dotted line replacing the AC input from transformer 192.

Output from 184 or 186 for a double or martini size drink from selection control, shown in FIG. 4, will activate one of three presetable counts A, B or C described in logic table 190 where zero plus one corresponds to logic level outputs 184 or 186.

Counters 203 and 205 are common to the logic tables and record any dispensing of an altered volume.

Each motor control 194 for a particular brand can have its own counter 204 or have leads to a counter which is common to all brands of a similar price range such as well brands mode group, call brands mode group, or premium brands mode group.

Each motor control 194 can drive a panel light 206 behind the particular brand on the display board, shown in FIG. 3 to indicate the brand being dispensed.

A thumb wheel switch 208 is disposed to change the preset numbers so the quantity dispensed may be changed by management for occasions such as happy hours without mechanical adjustment.

Figure 6:
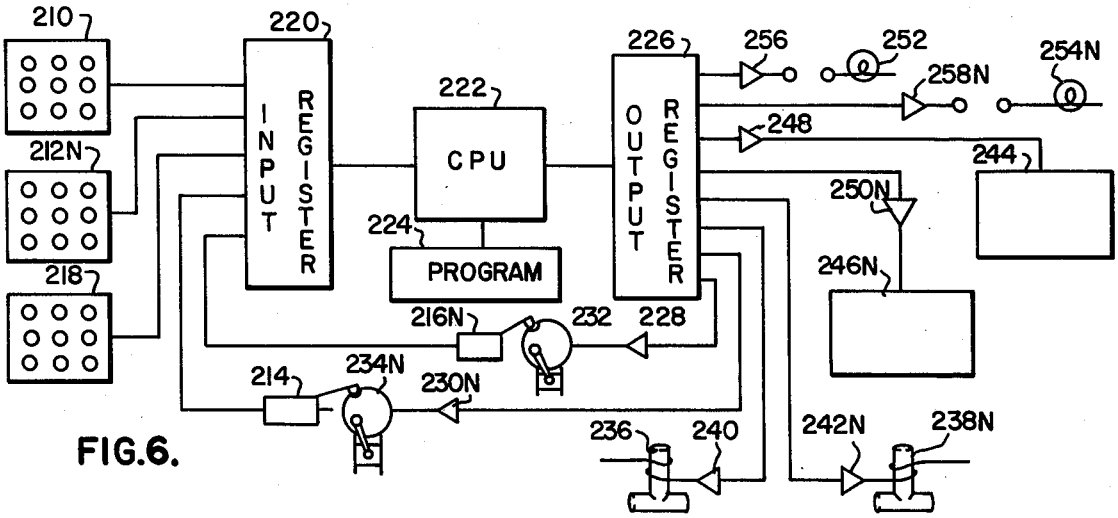
FIG. 6 is an alternate block diagram of a computerized system incorporating all selection control and dispensing functions.

Reference is hereby made to FIG. 6, showing a block diagram of how the selection and dispenser control might be accomplished for one or multiple dispenser systems utilizing a general purpose programable digital microprocessor such as, but not limited to, Motorola's MPU 6800 or RCA's CPU 1800. A special purpose microprocessor may also be utilized if desired.

Command inputs 210 and 212-N are the handset selector switches on one or a number of dispenser systems. Other command inputs are flow sensors or pump cycle counters 214 and 216-N.

Another command input would be a cycle count modifier 218 to change the preset quantity pumped electronically.

A suitable input register 220 supplies data to the microprocessor unit 222.

The program 224 directs the central processor to perform the functions described in FIGS. 4 and 5 of the drawings. A suitable output register 226 signals pump drivers 228 and 230-N to power liquor pumps 232 and 234-N. Syrup and carbonated water solenoid valves 236 and 238-N are operated through drivers 240 and 242-N. Counters 244 and 246-N receive signals through drivers 248 and 250-N. Lights 252 and 254-N are actuated through drivers 256 and 258-N.

Reference is hereby made to FIG. 7 of the drawings which is a fragmentary diagram of the selection control 24 shown in FIG. 1 of the drawings, to show an alternate method to that shown in FIG. 4, to accomplish simultaneous dispensation by simply delaying the dispensing of liquor after selection to give the bartender time to select the soda and thereby avoid spilling.

Liquor mode selector L on the dispenser handset 20 shown in FIG. 1 energizes flip-flop 260 to enable AND gate 262. Selection of liquor, for example, switch S starts time delay 265 through AND gate 262 and resets flip-flop through OR gate 263 to its normal state, soda mix, which enables AND gate 264. Actuation of soda mix buttons signals dispenser through AND gate 264 and proper driver to control solenoid valves for soda to dispense on demand of momentary switch S. An arrangement such as this might be used on a less sophisticated system where only one alternate mode group of liquor would be available and the selection board would not be lighted.

It will be obvious to those skilled in the art that various modifications may be resorted to without departing from the spirit of the invention.

I claim:

1. A beverage dispenser comprising a movable dispenser handset; a plurality of flexible liquid delivery conduits coupled to said dispenser handset for delivering liquid beverage ingredients thereto; a plurality of liquid delivery means for displacing liquid under pressure, comprising a normal mode group of said liquid delivery means and at least one alternate mode group of said liquid delivery means, each of said liquid delivery means coupled respectively to said liquid delivery conduits; a plurality of liquid ingredient supplies coupled respectively to said liquid delivery means; said dispenser handset having control switches and a plurality of selection switches; an electronic control means coupled in circuit with said control switches and said selection switches; said control means coupled in circuit with said liquid delivery means; said control means being responsive to the manual actuation of any one of said selection switches to energize a respective liquid delivery means from said normal mode group to cause the flow of liquid through respective conduits and said dispenser handset; a mode selector means in said control means for changing the functional connections of said selection switches to the alternate mode group of said liquid delivery means when energized by actuation of one of said control switches; said control means having the functional connections of said selector switches changed to said alternate mode group, being responsive to manual actuation of any one of said selection switches to energize said respective liquid delivery means from said alternate mode group to cause the flow of liquid through respective conduits and said dispenser handset; said mode selector means being responsive to the manual actuation of any selection switch to change the functional connections of said selection switches back to the normal mode group of said liquid delivery means.

2. The invention as defined in claim 1, wherein: a time delay means is provided for delaying the energizing of any of said liquid delivery means while said mode selector means has changed the functional connections of said selection switches to the alternate mode group of said liquid delivery means.

3. The invention as defined in claim 1, wherein: said mode selector means includes a means for changing the functional connections of one set of selector switches to any one mode group of multiple mode groups when energized by said control switches.

4. The invention as defined in claim 3, wherein: a time delay means is provided for delaying the energizing of any of said liquid delivery means after said mode selector means has changed the functional connections of said selector switches to any one of a plurality of mode groups of said liquid delivery means.

5. A beverage dispenser comprising a movable dispenser handset; a plurality of flexible liquid delivery conduits coupled to said dispenser handset for delivering liquid beverage ingredients thereto; a plurality of liquid delivery means for displacing liquid under pressure comprising a normal mode group of said liquid delivery means and at least one alternate mode group of said liquid delivery means, each of said liquid delivery means coupled respectively to said liquid delivery conduits; a plurality of liquid ingredient supplies coupled respectively to said liquid delivery means; said dispenser handset having control switches and a plurality of selection switches; an electronic control means coupled in circuit with said control switches and said selection switches; said control means coupled in circuit with said liquid delivery means; said control means having a selection memory means; a mode selector means in said control means for changing the functional connections of said selector switches to the alternate mode group of said liquid delivery means when energized by actuation of one of said control switches on said dispenser handset; said control means, having the functional connections of said selector switches changed to the alternate mode group by said mode selector means, being responsive to manual actuation of any one of said selector switches to retain that selection of said liquid delivery means in said memory means and to signal said mode selector means to change the functional connections of said selector switches back to the normal mode group of said liquid delivery means; said control means, having the functional connections of said selector switches coupled with the normal mode group of said liquid delivery means, being responsive to the manual actuation of any one of said selection switches to energize a respective liquid delivery means and to simultaneously signal the liquid delivery means corresponding to the selection held in said selection memory means to energize the respective liquid delivery means for causing the flow of said liquid ingredients simultaneously through their respective conduits and said dispenser handset.

6. The invention as defined in claim 5, wherein: said control means has a means causing said liquid delivery means to displace a predetermined quantity of the ingredient retrieved in accordance with said selection held in memory; said control means, while in the normal mode group, being responsive to the manual actuation of any one of said selector switches, energizes said respective liquid delivery means as long as, or as often as, said selector switch is actuated.

7. The invention as defined in claim 5, wherein: said control means, having the functional connections of said selector switches coupled with the normal mode group of said liquid delivery means, is responsive to the manual actuation of any one of said selection switches to energize a plurality of said liquid delivery means to cause the flow of a plurality of said liquid ingredients simultaneously through their respective conduits into said dispenser handset where said ingredients are mixed and dispensed.

8. The invention as defined in claim 5, wherein: said memory means comprises a plurality of electronic bi-stable memory means, each having an alterable state subject to the actuation of one of said selector switches; a plurality of gating means capable of being enabled; said gating means coupling said bi-stable memory means and said selector switches; a control bi-stable memory coupled with said control switch and said plurality of gating means; one of said bi-stable memory means, after having its state altered by one of said selection switches through one of said gating means enabled by said control bi-stable memory and said control switch, being responsive to the actuation of any of said selector switches to cause the operation of said respective liquid delivery means.

9. The invention as defined in claim 5, wherein: said plurality of liquid delivery means comprises a normal mode group of said liquid delivery means and multiple other mode groups of said liquid delivery means; each of said liquid delivery means coupled respectively to said liquid delivery conduits; said mode selector means in said control means for changing the functional connections of said selector switches to any mode group of the multiple mode groups of said liquid delivery means when energized by actuation of a respective one of said control switches on said dispenser handset; said control means having the functional connections of said selector switches changed to one mode group of the multiple mode groups by said mode selector means, being responsive to manual actuation of any of said selection switches to place that selection of one of said liquid ingredients in said memory means and signal said mode selector means to change the functional connections of said selector switches back to the normal mode group of said liquid delivery means.

10. The invention as defined in claim 9, wherein: a display board is correlated with said electronic control means listing multiple mode groups, each indicating the name of the ingredient to be dispensed by energizing a respective one of said liquid delivery means by manual actuation of said corresponding selector switch on said dispenser handset; each of said mode groups on said display board having a locational layout corresponding to the locational layout of said selector switches on said dispenser handset for selecting proper selector switches.

11. The invention as defined in claim 9, wherein: said mode selector means comprises two toggle flip-flops having alterable states subject to the actuation of one of said control switches; a binary to decimal decoder properly coupled and controlled by said toggle flip-flops and actuation of said control switch; said binary to decimal decoder having a normal zero state and alterable to the One state by one actuation of said control switch, the Two state by two actuations, and the Three state by three actuations; a plurality of mode groups, each having a plurality of AND gates, all coupled to one of said terminals on said binary to decimal decoder representing said various states; in one of said mode groups all AND gates remaining enabled depending on the state of said binary to decimal decoder; the other terminal of said enabled AND gates in that mode group being coupled with said selection switches and being operable to send a control signal to the respective liquid delivery means upon actuation of one of said selection switches.

* * * * *